US006497510B1

(12) United States Patent
Delametter et al.

(10) Patent No.: US 6,497,510 B1
(45) Date of Patent: Dec. 24, 2002

(54) DEFLECTION ENHANCEMENT FOR CONTINUOUS INK JET PRINTERS

(75) Inventors: Christopher N. Delametter, Rochester, NY (US); James Chwalek, Pittsford, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/470,638

(22) Filed: Dec. 22, 1999

(51) Int. Cl.[7] ..... B41J 2/07
(52) U.S. Cl. ..... 374/74
(58) Field of Search ..... 347/74, 77, 94, 347/75, 73, 82, 89

(56) References Cited

U.S. PATENT DOCUMENTS

| | | | | |
|---|---|---|---|---|
| 1,941,001 A | | 12/1933 | Hansell | 347/75 |
| 3,373,437 A | | 3/1968 | Sweet et al. | 347/75 |
| 3,416,153 A | | 12/1968 | Hertz et al. | 347/75 |
| 3,878,519 A | | 4/1975 | Eaton | 347/75 |
| 3,893,623 A | | 7/1975 | Toupin | 347/82 |
| 4,346,387 A | | 8/1982 | Hertz | 347/75 |
| 5,841,452 A | | 11/1998 | Silverbrook | 347/47 |
| 5,966,154 A | * | 10/1999 | DeBoer | 347/82 |

FOREIGN PATENT DOCUMENTS

| | | | | |
|---|---|---|---|---|
| EP | 0 308 272 A1 | | 3/1989 | |
| EP | 0 474 472 A1 | | 3/1992 | |
| EP | 0 805 036 A2 | * | 11/1997 | B41J/2/175 |
| EP | 0 911 167 A2 | | 4/1999 | |
| JP | 6-183029 A | * | 7/1994 | 347/89 |

* cited by examiner

*Primary Examiner*—Lamson Nguyen
(74) *Attorney, Agent, or Firm*—Walter S. Stevens

(57) ABSTRACT

A continuous ink jet printer having improved ink drop placement and image quality insuring from importing enhanced lateral flow characteristics, by geometric obstruction within it's ink delivery channel, which, in turn, enables enhanced ink drop deflection.

30 Claims, 7 Drawing Sheets

DEFLECTION ENHANCEMENT FOR CONTINUOUS INK JET PRINTERS

FIELD OF THE INVENTION

The present invention relates generally to the field of digitally controlled ink jet printing systems. It particularly relates to improving those systems that asymmetrically heat a continuous ink stream, in order to deflect the stream's flow between a non-print mode and a print mode.

BACKGROUND OF THE PRIOR ART

Ink jet printing is only one of many digitally controlled printing systems. Other digital printing systems include laser electrophotographic printers, LED electrophotographic printers, dot matrix impact printers, thermal paper printers, film recorders, thermal wax printers, and dye diffusion thermal transfer printers. Ink jet printers have become distinguished from the other digital printing systems because of the ink jet's non-impact nature, its low noise, its use of plain paper, and its avoidance of toner transfers and filing.

The ink jet printers can be categorized as either drop-on-demand or continuous systems However, it is the continuous ink jet system which has gained increasingly more recognition over the years. Major developments in continuous ink jet printing are as follows:

Continuous ink jet printing itself dates back to at least 1929. See U.S. Pat. No. 1,941,001 which issued to Hansell that year.

U.S. Pat. No. No. 3,373,437, which issued to Sweet et al. in March 1968, discloses an array of continuous ink jet nozzles wherein ink drops to be printed are selectively charged and deflected towards the recording medium. This technique is known as binary deflection continuous ink jet printing, and is used by several manufacturers, including Elmjet and Scitex.

U.S. Pat. No. 3,416,153, issued to Hertz et al. in December 1968. It discloses a method of achieving variable optical density of printed spots, in continuous ink jet printing. Therein the electrostatic dispersion of a charged drop stream serves to modulate the number of droplets which pass through a small aperture. This technique is used in ink jet printers manufactured by Iris.

U.S. Pat. No. 4,346,387, also issued to Hertz, but it issued in 1982. It discloses a method and apparatus for controlling the electrostatic charge on droplets. The droplets are formed by the breaking up of a pressurized liquid stream, at a drop formation point located within an electrostatic charging tunnel, having an electrical field. Drop formation is effected at a point in the electric field, corresponding to whatever predetermined charge is desired. In addition to charging tunnels, deflection plates are used to actually deflect the drops.

Until recently, conventional continuous ink jet techniques all utilized, in one form or another, electrostatic charging tunnels that were placed close to the point where the drops are formed in a stream. In the tunnels, individual drops may be charged selectively. The selected drops are charged and deflected downstream by the presence of deflector plates that have a large potential difference between them. A gutter (sometimes referred to as a "catcher") is normally used to intercept the charged drops and establish a non-print mode, while the uncharged drops are free to strike the recording medium in a print mode as the ink stream is thereby deflected, between the "non-print" mode and the "print" mode.

Recently, a novel continuous ink jet printer system has been developed which renders the above-described electrostatic charging tunnels unnecessary. Additionally, it serves to better couple the functions of (1) droplet formation and (2) droplet deflection. That system is disclosed in our copending U.S. patent application Ser. No. 08/954,317 entitled "CONTINUOUS INK JET PRINTER WITH ASYMMETRIC HEATING DROP DEFLECTION", herein incorporated by reference. Therein disclosed is an apparatus for controlling ink in a continuous ink jet printer. The apparatus comprises an ink delivery channel, a source of pressurized ink in communication with the ink delivery channel, and a nozzle having a bore which opens into the ink delivery channel, from which a continuous stream of ink flows. A droplet generator inside the nozzle causes the ink stream to break up into a plurality of droplets at a position spaced from the nozzle. The droplets are deflected by heat from a heater (in the nozzle bore) which heater has a selectively actuated section, i.e. a section associated with only a portion of the nozzle bore. Selective actuation of a particular heater section, at a particular portion of the nozzle bore produces what has been termed an asymmetrical application of heat to the stream. Alternating the sections can, in turn, alternate the direction in which this asymmetrical heat is applied and serves to thereby deflect the ink droplets, inter alia, between a "print" direction (onto a recording medium) and a "non-print" direction (back into a "catcher").

Asymmetrically applied heat results in steam deflection, the magnitude of which depends upon several factors, e.g. the geometric and thermal properties of the nozzles, the quantity of applied heat, the pressure applied to, and the physical, chemical and thermal properties of the ink. Although solvent-based (particularly alcohol-based) inks have quite good deflection patterns, and achieve high image quality in asymmetrically heated continuous ink jet printers, water-based inks until now, have not. Water-based inks require a greater degree of deflection for comparable image quality than the asymmetric treatment, jet velocity, spacing, and alignment tolerances have in the past allowed. Accordingly, a means for enhancing the degree of deflection for such continuous ink jet systems, within system tolerances would represent a surprising but significant advancement in the art and satisfy an important need in the industry for water-based, and thus more environmentally friendly inks.

SUMMARY OF THE INVENTION

It is therefore a principal object of the present invention to improve the magnitude of ink droplet deflection within continuous ink jet asymmetrically heated printing systems, without negating otherwise acceptable system tolerances.

It is also an object of the present invention to provide an asymmetrically heated printing system which better accommodates water-based inks.

It is an additional object of this invention to improve image quality by allowing the systems image receiver, e.g. paper or other print media to be placed closer to the print head.

These objects and others, which will become apparent from reading the Detailed Description, are fulfilled generally by increasing the lateral flow of ink, entering the nozzle bore section of continuous ink jet printer systems, of the type employing asymmetrical heating for drop deflection. Said lateral flow is increased by imposing particular geometric obstructions at a position upstream from the nozzle bore entrance.

DETAILED DESCRIPTION OF THE INVENTION

The present description will be directed, in particular, to elements forming part of, or cooperating directly with, apparatus or processes of the present invention. It is to be understood that elements not specifically shown or described may take various forms well known to those skilled in the art.

Figure 1:
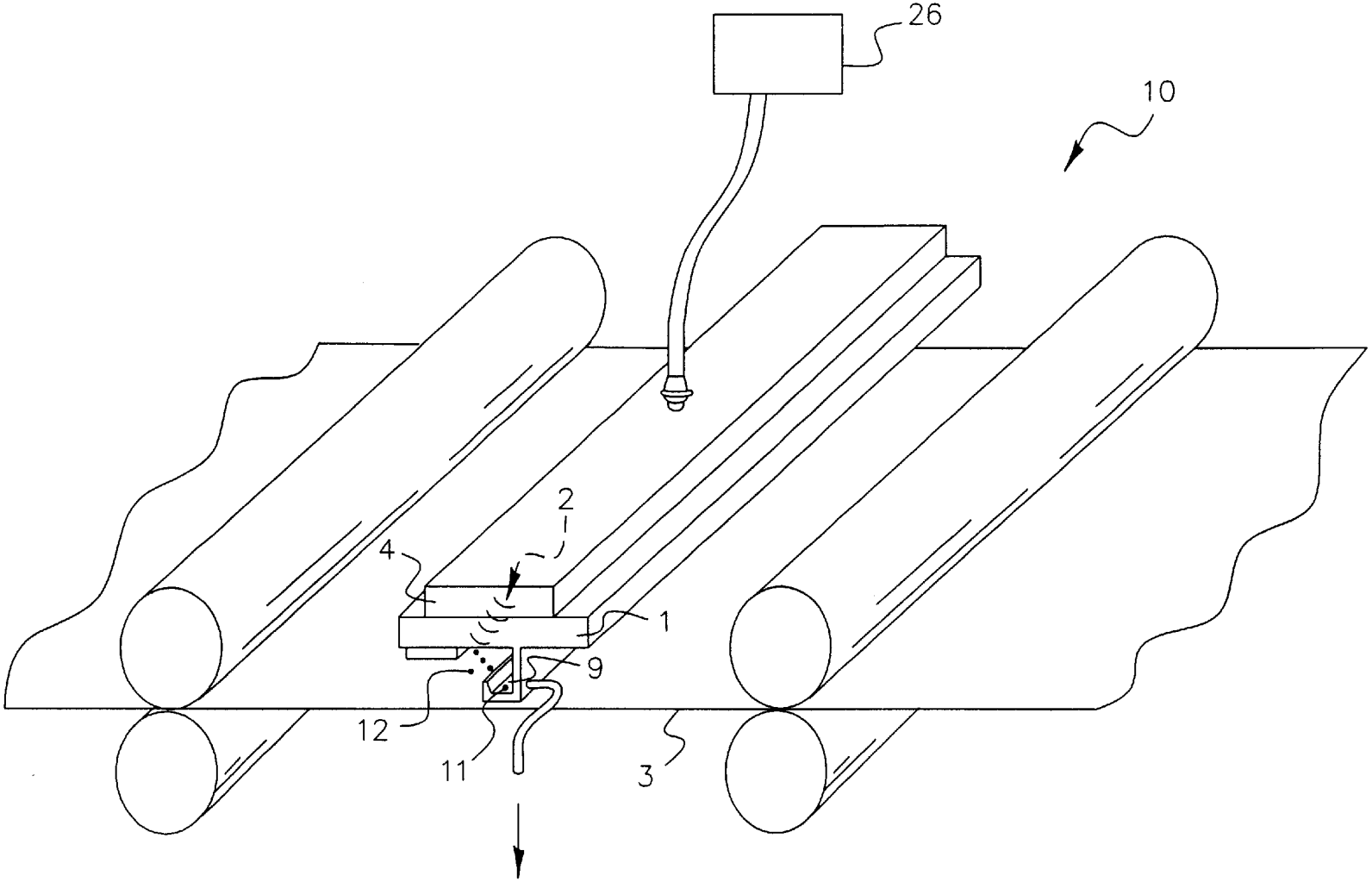
FIG. 1 shows a schematic diagram of an exemplary continuous ink jet print head an(d nozzle array as a print medium (e.g. paper) rolls under the ink jet print head.

Referring to FIG. 1, a continuous ink jet printer system is generally shown at 10. The print head 1, from which extends an array of nozzle heaters 2, houses heater control circuits (not shown) which process signals to an ink pressure regulator (not shown).

Heater control circuits read data from the image memory, and send time-sequenced electrical pulses to the array of nozzle heaters 2. These pulses are applied at an appropriate time, and to the appropriate nozzle, so that drops formed from a continuous ink jet stream will form spots on a recording medium 3, in the appropriate position designated by the data sent from the image memory. Pressurized ink travels from an ink reservoir 26 to an ink delivery channel 4 and through nozzle array 2 onto either the recording medium 3 or the gutter 9. Pressurized ink travels from an ink reservoir 26 to an ink delivery channel 4 and through nozzle array 2 onto either recording medium 3 or the gutter.

Figure 2:
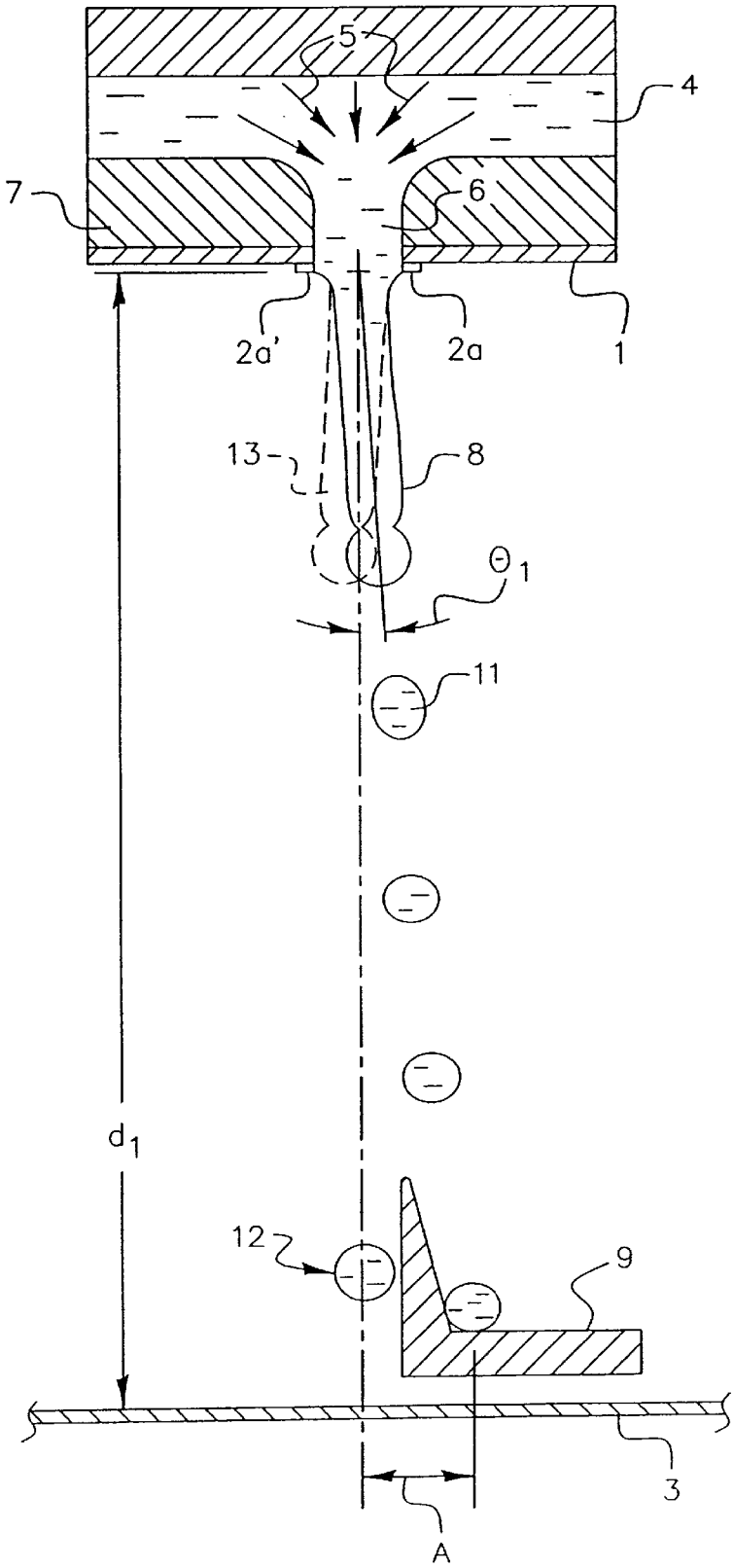
FIG. 2 (prior art)
FIG. 2 is a cross-sectional view of one nozzle tip from a prior art nozzle array showing, $d_1$ (distance to print medium) and $\theta_1$ (angle of deflection).
Figure 3:
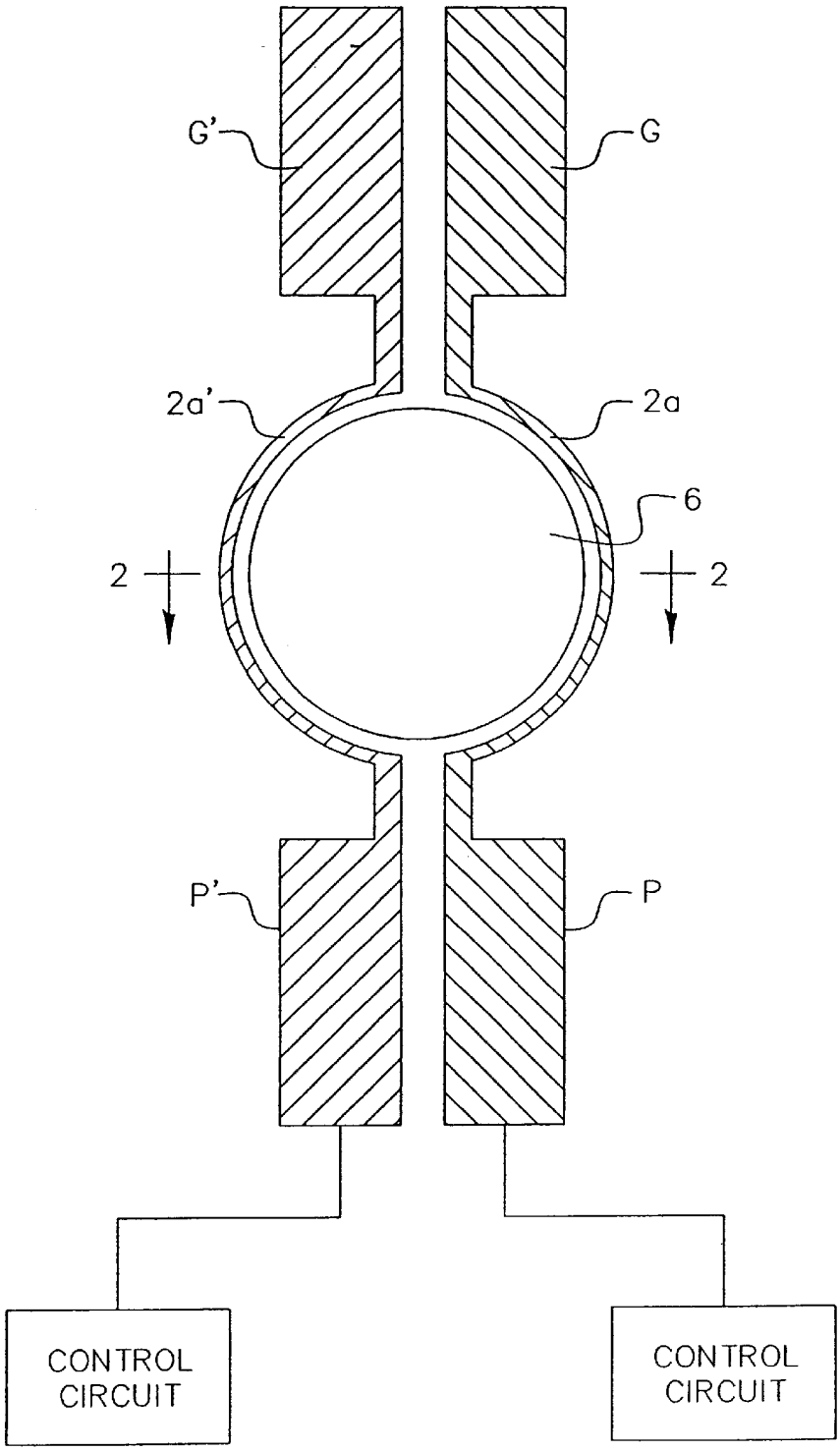
FIG. 3 shows a top view directly into a nozzle with an asymmetric heater surrounding the nozzle.

FIG. 3 is an expanded bottom view of heater 2*a*/2*a*' showing the line 2—2, along which line the FIG. 2 cross-sectional illustration is viewed. Heater 2*a*/2*a*' can be seen to have two sections (sections 2*a* and 2*a*'). Each section covers approximately one half of the nozzle bore opening 6. Alternatively, heater sections can vary in Lumber and sectional design. One section provides a common connection G, and isolated connection P. The other has G' and P' respectively. Asymmetrical application of heat merely means applying electrical current to one or the other section of the heater independently. By so doing, the heat will deflect the ink stream 8, and deflect the drops 11, away from the particular source of the heat. For a given amount of heat, the ink drops 11 are deflected at an angle $\theta_1$ (in FIG. 2) and will travel a vertical distance $d_1$ onto recording media 3 from the print head. There also is a distance "A", which distance defines the :pace between where the deflection angle $\theta_1$ would place the deflected drops 11 on the recording media (or a catcher) and where the drops 12 would have landed without deflection. The stream deflects in a direction anyway from the application of heat. The ink gutter 9 is configured to catch deflected ink droplets 11 while allowing undeflected drop 12 to reach a recording medium. An alternative embodiment of the present invention could reorient ink gutter ("catcher") 9 to be placed so as to catch undeflected drops 12 while allowing deflected drops 11 to reach the recording medium.

The ink in the delivery channel emanates from a pressurized reservoir 26, leaving the ink in the channel under pressure. In the past the ink pressure suitable for optimal operation would depend upon a number of factors, particularly geometry and thermal properties of the nozzles and thermal properties of the ink. A constant pressure can be achieved by employing an ink pressure regulator (not shown).

Figure 4:
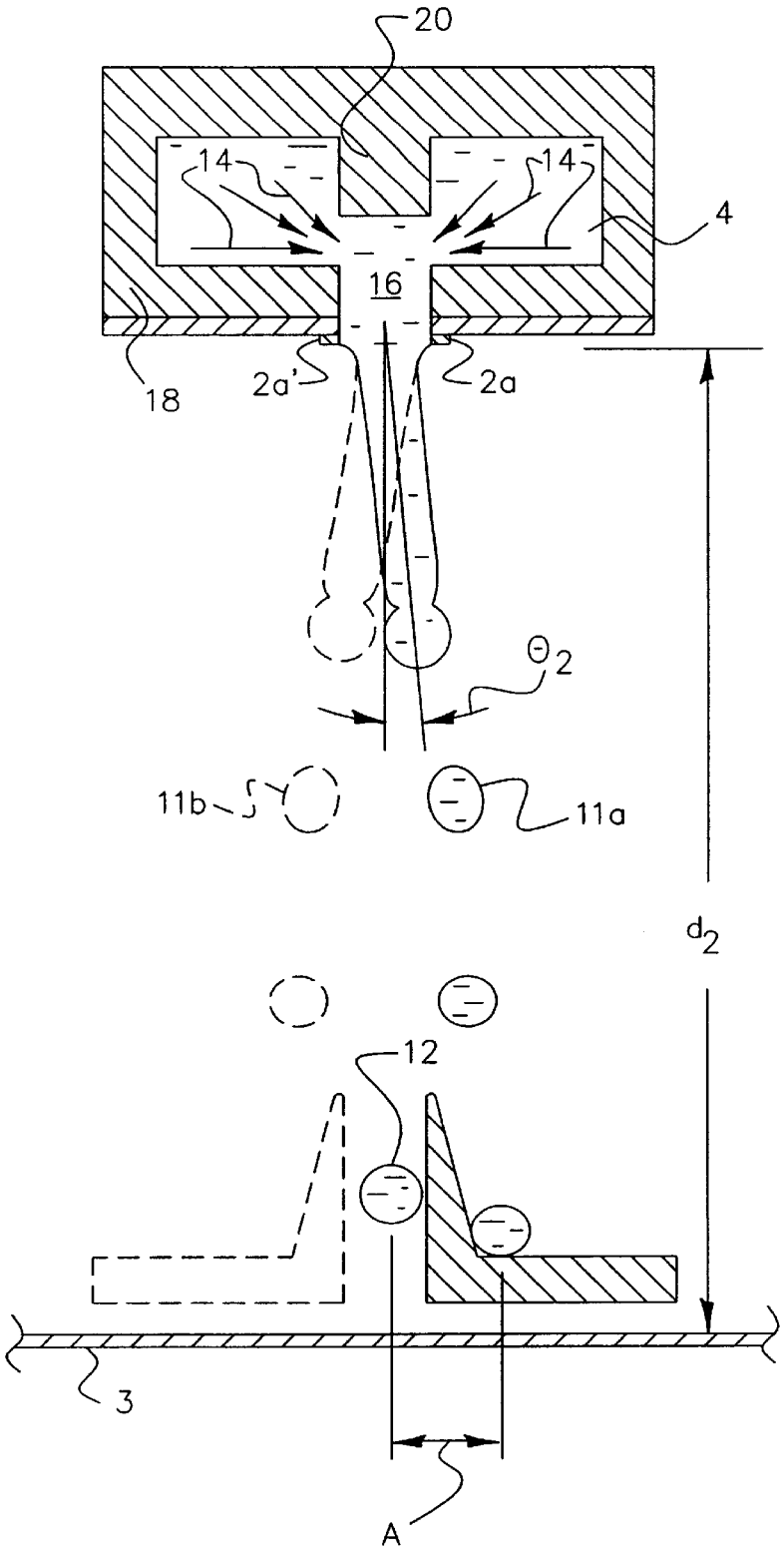
FIG. 4 is a cross-sectional view of one nozzle tip from one embodiment of the present invention showing $d_2$ and $\theta_2$.
Figure 4A:
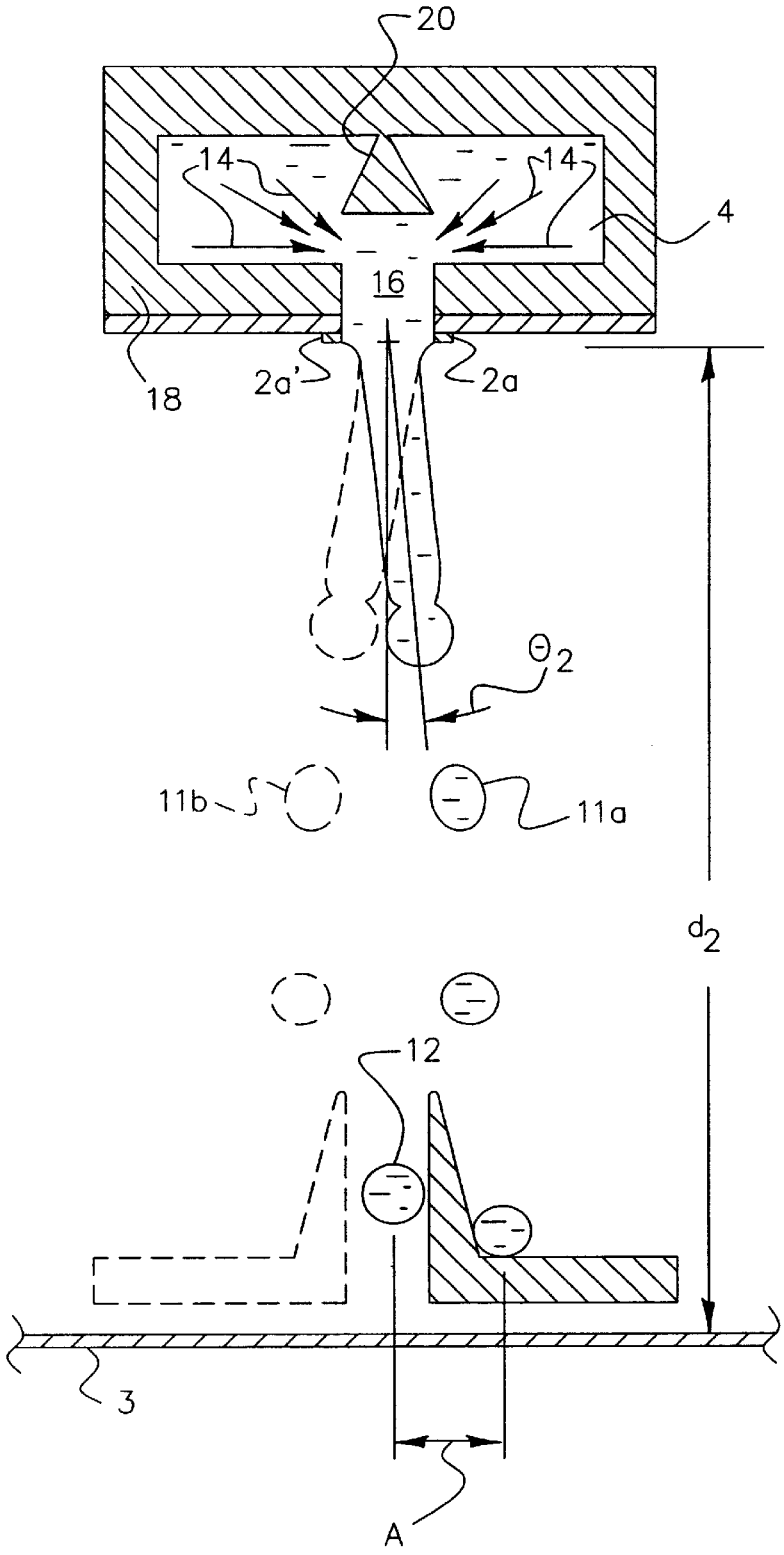
FIG. 4A is a cross-sectional view of one nozzle tip from another embodiment of the present invention.

Referring to FIG. 4, in the operation of the present invention, the lateral course of ink flow patterns 14 in the ink delivery channel 4, are enhanced by, a geometric obstruction 20, placed in the delivery channel 4, just below the nozzle bore 16. This lateral flow enhancing obstruction 20 can be varied in size, shape and position, but serves to improve the deflection by many times x, based upon the lateralness of the flow and can therefore reduce the dependence upon ink properties (i.e. surface tension, density, viscosity, thermal conductivity, specific heat, etc.), nozzle geometry, and nozzle thermal properties while providing greater degree of control and improved image quality. Preferably the obstruction 20 has a lateral wall parallel to the reservoir side of wall 18, such as squares, cubes, rectangles, triangles (shown in FIG. 4A with like features being represented using like reference symbols), etc. The deflection enhancement may be seen by comparing, for example the margins of difference between $\theta_1$ of FIG. 2 and $\theta_2$ of FIG. 4. This increased stream deflection enables improvements in drop placement (and thus image quality) by allowing the recording medium 3 to be placed closer to the print head 1 ($d_2$ is less than $d_1$) while preserving the other system level tolerances (i.e. spacing, alignment etc.) for example see distance A. The orifice membrane or wall 7 can also be thinner. We have found that a thinner wall provides additional enhancement in deflection which, in turn, serves to lessen the amount of heat needed per degree of the angle of deflection $\theta_2$.

Figure 5:
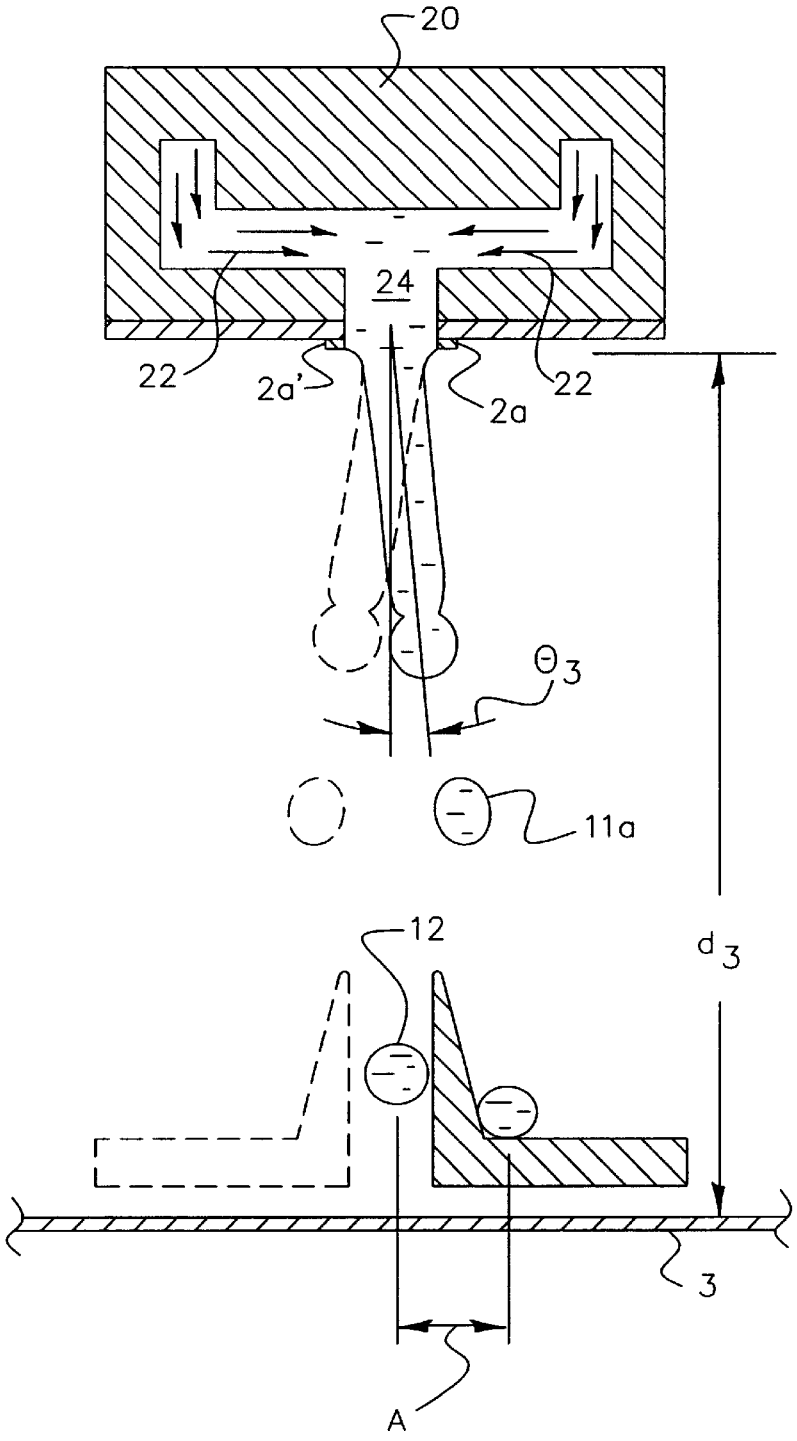
FIG. 5 is a cross-sectional view of one nozzle tip from a preferred embodiment of the present invention showing $d_3$ and $\theta_3$.

Referring now to FIG. 5 drop placement and thus image quality can be even further enhanced by an obstruction 20 which provides almost total lateral flow 22 at the entrance to nozzle bore 24. The distance $d_3$ to print medium 3 is again lessened per degree of heat because deflection angle $\theta_3$ can be increased per unit temperature.

Figure 6:
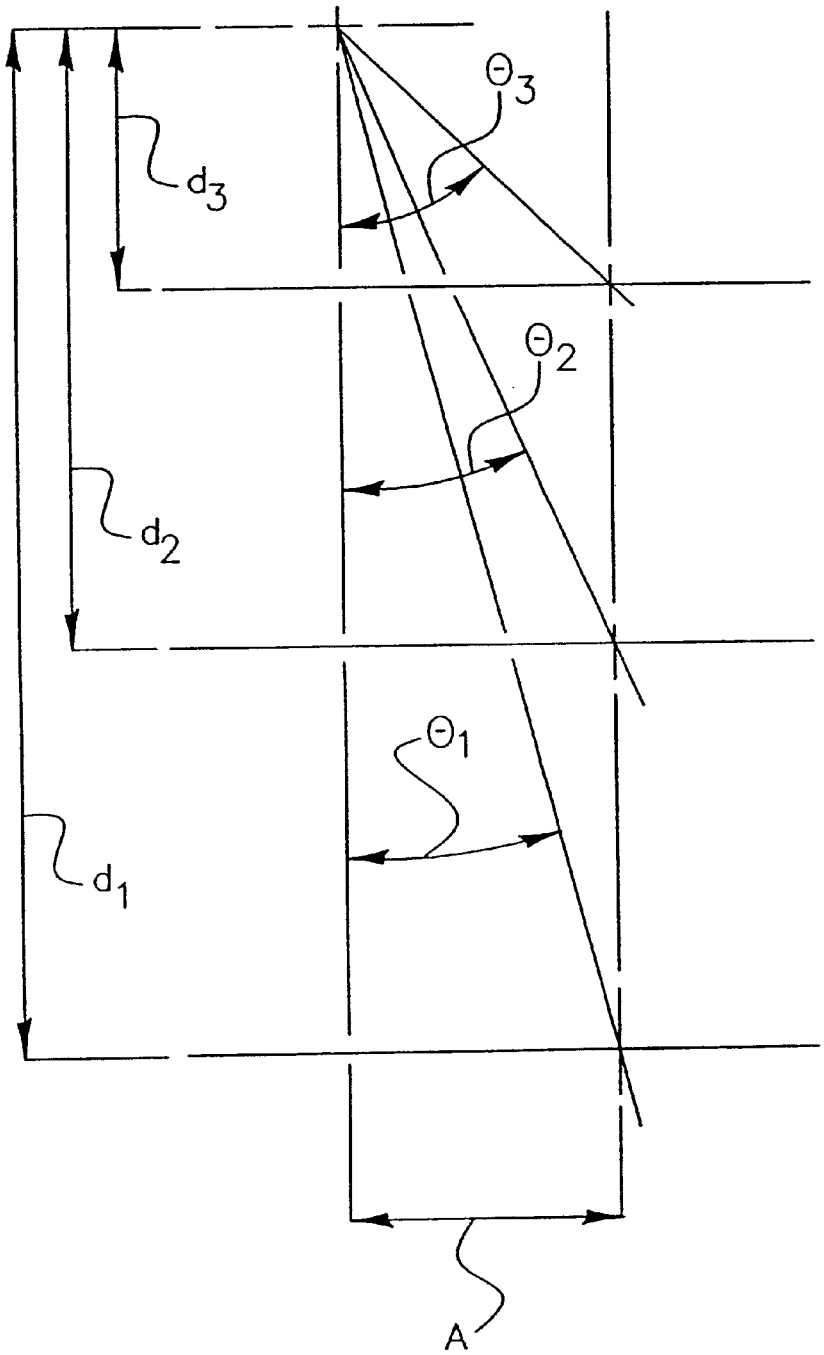
FIG. 6 is a graph illustrating the relationships between $d_1$–$d_3$, $\theta_1$–$\theta_3$, and A.

FIG. 6 shows the relationship of a constant drop placement A as distances to the print media $d_1$, $d_2$, and $d_3$ become less and less and as deflection angles $\theta_1$, $\theta_2$, and $\theta_3$ become increasingly larger. As a consequence of enhanced lateral flow, the ability to miniaturize the printer's structural dimensions while enhancing image size, and enhancing image detail is achieved.

PARTS LIST

1. printhead
2. nozzle heater array
2*a* nozzle heater section
2*a*' nozzle heater section
3. recording medium
4. ink delivery (channel
5. ink flow pattern
6. nozzle bore
7. orifice membrane wall
8. ink stream

9. ink gutter or catcher
10. ink printer system generally
11. deflected ink drops
12. undeflected ink drops
13. ink meniscus
14 lateral flow patterns
16 nozzle bore
18 wall
22 lateral flow
24 nozzle bore
$\theta_1$, $\theta_2$, $\theta_3$ angle, of deflection
$d_1$, $d_2$, $d_3$ distances to print medium
A is the spacing between undeflected drop on print medium and deflected drop on recording medium
G, G' ground portions on heater sections
P, P' power connections on heater sections

What is claimed is:

1. An apparatus for controlling ink in a continuous ink jet printer in which a continuous stream of ink is emitted from a nozzle, said apparatus comprising:

an ink delivery channel having a long dimension, the ink delivery channel having disposed therein a geometric obstruction to cause lateral flow of the ink at a predetermined magnitude in a direction substantially perpendicular to the long dimension of tile ink delivery channel;

a source of pressurized ink;

the source of pressurized ink communicating with the ink delivery channel;

a nozzle bore that opens into the ink delivery channel and through an orifice membrane wall to establish a continuous flow of ink in a stream, the nozzle bore defining a nozzle bore perimeter; and a nozzle heater having a selectively actuated section associated with only a portion of the nozzle bore perimeter, whereby actuation of the heater section produces an asymmetric application of heat to the stream which controls the stream direction there by enabling the stream to deflect in a direction away from the applied heat, an d which deflection is in a magnitude proportional to the lateral flow magnitude.

2. The apparatus of claim 1, wherein the geometric obstruction includes a lateral wall positioned parallel to the orifice membrane wall.

3. The apparatus of claim 2, wherein the lateral wall has a length which is directly proportional to the magnitude of the lateral flow.

4. The apparatus of claim 2, wherein the geometric obstructor. is selected from the group of geometries consisting of rectangular, cubical, and triangular.

5. A method of continuously deflecting ink drops comprising:

providing a printhead having an ink delivery channel in fluid communication with a nozzle bore, the ink delivery channel having a long dimension;

providing a heater positioned in adjacent to the nozzle bore;

providing an obstruction in the ink delivery channel shaped to create a lateral flow ,attempt substantially perpendicular to the long dimension of the ink delivery channel;

delivering ink to the nozzle through the delivery channel under pressure sufficient to expel the ink from the nozzle, the ink passing by the obstruction such that a lateral flow component of a predetermined magnitude is created in the ink; and selectively actuating a portion of the heater such that the ink ejected from the nozzle bore is deflected at a predetermined angle as measured from a line perpendicular to the nozzle bore, the predetermined angle of deflection being proportional to the magnitude of the lateral flow component.

6. The method according to claim 5, further comprising:

providing the obstruction with a lateral wall extending beyond the nozzle bore.

7. The method according to claim 5, further comprising:

providing the obstruction with vertical walls positioned in the ink delivery channel at locations extending beyond the nozzle bore.

8. The method according to claim 5, the nozzle bore having a diameter, the method further comprising:

providing the obstruction with vertical walls positioned in the ink delivery channel at locations substantially equivalent to the diameter of the nozzle bore.

9. A continuous inkjet printing apparatus comprising:

an ink delivery channel having a long dimension;

a nozzle bore in fluid communication with the ink delivery channel;

an obstruction positioned in the ink delivery channel, the obstruction being shaped to create a lateral flow pattern substantially perpendicular to the long dimension of the ink delivery channel for ink travelling in the ink delivery channel, the lateral flow pattern having a predetermined magnitude; and nozzle heater having a selectively actuated section associated with a portion of the nozzle bore, wherein selectively actuating the section of the heater deflects ink ejected from the nozzle bore at a predetermined angle as measured from a line perpendicular to the nozzle bore, the predetermined angle of deflection being proportional to the magnitude of the lateral flow pattern.

10. The apparatus according to claim 9, further comprising:

a soure of ink in fluid communication with the ink delivery channel, the ink being under pressure sufficient to expel the ink from the nozzle bore.

11. The apparatus according to claim 9, wherein a portion of the obstruction is positioned over the nozzle bore.

12. The apparatus according to claim 11, the nozzle bore being positioned in a wall membrane, the obstruction having a lateral wall, wherein the lateral wall of the obstruction is positioned in the ink delivery channel parallel to the wall membrane.

13. The apparatus according to claim 11, the nozzle bore having a diameter, the obstruction having vertical walls, wherein the vertical walls of the obstruction are positioned in the ink delivery channel at locations extending beyond the diameter of the nozzle bore.

14. The apparatus according to claim 9, the obstruction having a rectangular cross section as viewed from a plane perpendicular to the nozzle bore.

15. The apparatus according to claim 9, the obstruction having a square cross section as viewed from a plane perpendicular to the nozzle bore.

16. A continuous inkjet printhead comprising:

an ink delivery channel;

a nozzle bore in fluid communication with the ink delivery channel, the nozzle bore having a diameter;

an obstruction positioned in the ink delivery channel, the obstruction having vertical walls, the vertical walls of the obstruction being positioned in the ink delivery channel at locations substantially equivalent to the diameter of the nozzle bore to create a lateral flow pattern in ink travelling along the ink delivery channel, the lateral flow pattern having a predetermined magnitude; and a nozzle heater having a selectively actuated section associated with a portion of the nozzle bore, wherein selectively actuating the section of the heater deflects ink ejected from the nozzle bore at a predetermined angle as measured from a line perpendicular to the nozzle bore, the predetermined angle of deflection being proportional to the magnitude of the lateral flow pattern.

17. The continuous ink jet printhead according to claim 16, the nozzle bore being positioned in a wall membrane, the obstruction having a lateral wall, wherein the lateral wall of the obstruction is positioned in the ink delivery channel parallel to the wall membrane.

18. The continuous ink jet printhead according to claim 16, wherein the obstruction has a rectangular cross section as viewed from a plane perpendicular to the nozzle bore.

19. A continuous ink jet printhead comprising:

an ink delivery channel;

a nozzle array having a long dimension, the nozzle array being in fluid communication with the ink delivery channel, the nozzle array having at least one nozzle bore;

an obstruction positioned in the ink delivery channel, the obstruction being shaped lo create a lateral flow pattern substantially perpendicular to the long dimension of the nozzle array for fluid travelling in the ink delivery channel; and a nozzle heater having a selectively actuated section associated with a portion of the at least one nozzle bore, wherein selectively actuating the section of the heater deflects fluid ejected from the at least one nozzle bore at a predetermined angle as measured from a line perpendicular to the at least one nozzle bore.

20. The printhead according to claim 19, wherein a portion of the obstruction is positioned over the nozzle array.

21. The printhead according to claim 20, the nozzle array being positioned in a wall membrane, the obstruction having a lateral wall, wherein the lateral wall of the obstruction is positioned in the ink delivery channel parallel to the wall membrane.

22. The printhead according to claim 20, the nozzle array having at least on e nozzle bore having a diameter, the obstruction having vertical walls, wherein the vertical walls of the obstruction are positioned in the ink delivery channel at locations extending beyond the diameter of the at least one nozzle bore.

23. The printhead according to claim 19, the obstruction having a rectangular cross section as viewed from a plane perpendicular to the nozzle array.

24. The printhead according to claim 19, the obstruction having a square cross section as viewed from a plane perpendicular to the nozzle array.

25. A continuous ink jet printhead comprising:

an ink delivery channel;

a nozzle array having a long dimension, the nozzle array being in fluid communication with the ink delivery channel, the nozzle array having at least one nozzle bore having a diameter; and an obstruct positioned in the ink delivery channel, the obstruction being shaped lo create a lateral flow pattern substantially perpendicular to the long dimension of the nozzle array for fluid travelling in the ink delivery channel, the obstruction having vertical walls, wherein the vertical walls of the obstruction are positioned in the ink delivery channel at locations substantially equivalent to the diameter of the at least one nozzle bore.

26. A method of manufacturing a continuous ink jet printhead comprising:

providing a body;

forming an ink delivery channel in the body;

forming a nozzle array having a long dimension in the body, the nozzle array being in fluid communication with the ink delivery channel and having at least one nozzle bore;

positioning an obstruction in the ink delivery channel shaped to create a lateral flow pattern substantially perpendicular to the long dimension of the nozzle array for fluid travelling in the ink delivery channel; and positioning a nozzle heater having a selectively actuated section associated with a portion of the at least one nozzle bore.

27. The method according to claim 26, wherein positioning an obstruction in the ink delivery channel includes positioning a portion of the obstruction over the nozzle array.

28. The method according to claim 27, the nozzle array being positioned in a wall membrane of the body, the obstruction having a lateral wall, wherein positioning an obstruction in the ink delivery channel includes positioning the lateral wall of the obstruction parallel to the wall membrane.

29. The method according to claim 27, the nozzle array having at least one nozzle bore having a diameter, the obstruction having vertical walls, wherein positioning an obstruction in the ink delivery channel includes positioning the vertical walls of the obstruction in the ink delivery channel at locations extending beyond the diameter of the at least one nozzle bore.

30. A method of manufacturing a continuous ink jet printhead comprising:

providing a body;

forming an ink delivery channel in the body;

forming a nozzle array having a long dimension in the body, the nozzle array being in fluid communication with the ink delivery channel, the nozzle array having at least one nozzle bore having a diameter; and positioning an obstruction in the ink delivery channel shaped to create a lateral flow pattern substantially perpendicular to the long dimension of the nozzle array for fluid travelling in the ink delivery channel, the obstruction having vertical walls, wherein the vertical walls of the obstruction are positioned in the ink delivery channel at locations substantially equivalent to the diameter of the at least one nozzle bore.

* * * * *